US009649686B2

(12) United States Patent
Ucok et al.

(10) Patent No.: US 9,649,686 B2
(45) Date of Patent: May 16, 2017

(54) CASTING PREFORMS AND METHODS OF USE THEREOF

(75) Inventors: Ibrahim Ucok, Simpsonville, SC (US); Junyoung Park, Greer, SC (US); Jason Robert Parolini, Greer, SC (US)

(73) Assignee: General Electric Company, Schenectady, NY (US)

( * ) Notice: Subject to any disclaimer, the term of this patent is extended or adjusted under 35 U.S.C. 154(b) by 167 days.

(21) Appl. No.: 13/402,663

(22) Filed: Feb. 22, 2012

(65) Prior Publication Data

US 2013/0216813 A1 Aug. 22, 2013

(51) Int. Cl.
*B22D 19/02* (2006.01)
*B22D 13/06* (2006.01)

(52) U.S. Cl.
CPC ..... *B22D 19/02* (2013.01); *B22D 13/066* (2013.01); *Y10T 428/249921* (2015.04); *Y10T 428/31678* (2015.04)

(58) Field of Classification Search
CPC ..... B22D 19/02; B22D 19/04
USPC ..... 164/332, 333, 334, 369
See application file for complete search history.

(56) References Cited

U.S. PATENT DOCUMENTS 5,241,737 A * 9/1993 Colvin ..... B22D 19/02 164/112
5,295,530 A * 3/1994 O'Connor et al. ..... B22C 9/04 164/133
5,337,803 A * 8/1994 Divecha et al. ..... 164/98
6,244,327 B1 * 6/2001 Frasier ..... 164/34
6,530,416 B1 * 3/2003 Tiemann ..... 164/137
8,615,875 B2 * 12/2013 Alquier et al. ..... 29/889.721
2006/0276875 A1 * 12/2006 Stinson et al. ..... 623/1.15

FOREIGN PATENT DOCUMENTS

GB 576272 A 3/1946
JP 43-026972 B 11/1968
JP S52-126617 A 10/1977
JP 64-071565 3/1989

(Continued)

OTHER PUBLICATIONS

Adelakin, Tunde Kinglsey, et al, Influence of Centrifugal Casting Preocessing Parameters of the Distribution of Reinforcing Particles in Aluminum Matrix Composites, Supplemental Proceedings: vol. 2, pp. 99-104, 2008, PR China.

(Continued)

*Primary Examiner* — Kevin P Kerns
(74) *Attorney, Agent, or Firm* — Dority & Manning, PA

(57) ABSTRACT

Casting preforms are provided including a casting preform assembly; and a plurality of geometrically shaped bodies, wherein the plurality of geometrically shaped bodies are arranged or interconnected to form the casting preform assembly. Also provided is a method of using a casting preform, including forming a casting preform assembly, wherein the casting preform assembly includes a plurality of geometrically shaped bodies; anchoring the casting preform to an outer surface of a casting mold; introducing a fluid casting material into the casting mold; applying centrifugal force to the casting mold; forming a molded article, wherein at least a portion of the surface of the molded article is reinforced with the plurality of geometrically shaped bodies.

6 Claims, 5 Drawing Sheets

(56) References Cited

FOREIGN PATENT DOCUMENTS

| | | | |
|---|---|---|---|
| JP | 05-293621 | | 11/1993 |
| JP | 2004-174578 | A | 6/2004 |
| JP | 2005-273439 | | 10/2005 |
| JP | 2008-049399 | | 3/2008 |
| RU | 2230628 | | 6/2004 |

OTHER PUBLICATIONS

Niu, Libin et al, "Preparation of in situ-formed WC/Fe composite on gray cast iron subtrate by a centrifugal casting process", Journal of Material Processing Technology 210 (210) 1986-1990, Elsevier B.V., pp. 1-5, Jul. 12, 2010.

* cited by examiner

CASTING PREFORMS AND METHODS OF USE THEREOF

BACKGROUND OF THE INVENTION

The subject matter disclosed herein relates to casting preforms and methods of use thereof, and more particularly to casting preforms which provide targeted reinforcement to molded articles in order to improve certain physical properties, and methods of using the casting preforms.

Casting is a process for shaping a material, such as a ceramic, polymeric or metallic material, into a solid article when it is in fluid form. Casting provides an efficient and economical commercial manufacturing process for producing molded articles having desired or complex shapes. In the casting process, a liquid material is poured or introduced into a mold containing a hollow cavity of the desired shape where the liquid material solidifies upon cooling. The newly formed solid is termed a "casting." Once solidified, the casting is ejected, broken out of, or otherwise removed from the mold, allowing for repetition of the molding process to produce multiple molded articles. Metal, ceramic, or plastic, are among the most common types of materials used in mold casting.

Molded articles are subjected to various physical stresses during their use or operation. The types of physical stresses that molded articles experience varies with the particular application in which they are used. For example, molded articles used as components in gas turbine engines which are subjected to high temperatures or rotary motion suffer from wear, fatigue, tensile and creep stresses. These physical stresses detrimentally affect the performance of the article, increase the need for maintenance and the frequency of routine service interval periods and decrease the overall lifetime of use of the article before the article is replaced. Such maintenance and replacement represent a substantial economic cost.

One approach to reinforcing molded articles produced via casting is the use of casting preforms. A casting preform, or insert, is a self-sustaining body which is incorporated into fluid casting material during the casting process, thereby forming a reinforced metal matrix. Casting preforms provide structural reinforcement and physical enhancements to the molded article.

Therefore, a need exists for casting preforms and methods of use thereof which provide targeted reinforcement to molded articles in order to increase certain physical properties, such as resistance to wear, high-temperatures, stresses, aggressive environments or a combination comprising at least one of the foregoing, thereby extending the period of time between service intervals or the lifetime of the component, or both.

BRIEF DESCRIPTION OF THE INVENTION

According to one aspect of the invention, a casting preform comprises a casting preform assembly and a plurality of geometrically shaped bodies, wherein the plurality of geometrically shaped bodies are arranged or interconnected to form the casting preform assembly.

According to another aspect of the invention, a method, comprises forming a casting preform comprising a casting preform assembly, wherein the casting preform assembly comprises a plurality of geometrically shaped bodies; anchoring the casting preform to an outer surface of a casting mold; introducing a fluid casting material into the casting mold; applying centrifugal force to the casting mold; and forming a molded article, wherein at least a portion of the surface of the molded article is reinforced with the plurality of geometrically shaped bodies.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Embodiments described herein generally relate to casting preforms and methods of use thereof, and more particularly to casting preforms which provide targeted reinforcement of molded articles to improve certain physical properties of the molded article, and methods of using the casting preforms.

Figure 1:
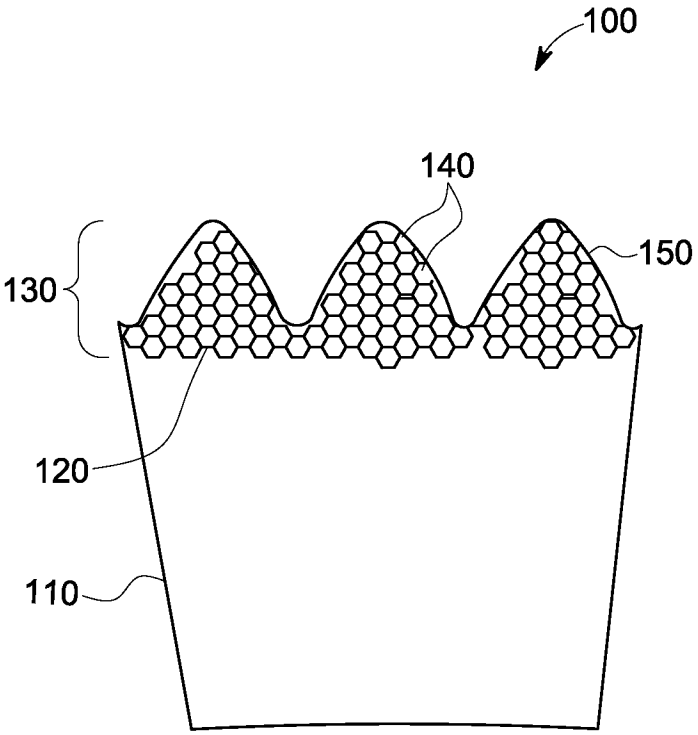
FIG. 1 is a cross-sectional view of a casting preform.

With reference to FIG. 1, a molding apparatus 100 comprises a casting mold 110 and a casting preform 120. The casting preform 120 comprises a casting preform assembly 130 and a plurality of geometrically shaped bodies 140, wherein the plurality of geometrically shaped bodies 140 are arranged or interconnected to form the casting preform assembly 130. The casting preform 120 is disposed within an outer area 150 of the casting mold 110. The outer area 150 of the casting mold 110 corresponds to the outer area, or at least a portion of the outer area or surface of, the molded article which is produced from the casting mold 110. The casting preform 120 is shaped to fit within the interior of the casting mold 110. The casting preform assembly 130 is formed into any shape or pattern desired for a selected casting mold 110. The plurality of geometrically shaped bodies 140 are arranged or interconnected to form the overall shape of the casting preform assembly 130, which is complimentary to at least a portion of the outer area 150 of the casting mold 110.

The casting preform 120 is disposed in a stationary position within the outer area 150 of the casting mold 110 by anchoring the casting preform assembly 130 to the casting mold 110. Anchoring the casting preform assembly 130 to the casting mold 110 allows for the reinforcement of desired physical properties in a targeted, or specific, location of the molded article produced using the casting mold 110. In an embodiment, the casting preform 120 is disposed in a stationary position by forming the casting preform assembly 130 into a shape which is complimentary to the outer area 150 of the casting mold 110. In another embodiment, the casting preform 120 is disposed in, or fixed in, a stationary position by affixing the casting preform assembly 130 to the casting mold 110. For example, in a specific embodiment, the casting preform 120 is disposed in a stationary position by affixing the casting preform assembly 130 to the casting mold 110 using a chaplet (not shown). The chaplet is made of similar or dissimilar materials than those of the casting preform depending on the desired application or properties. The casting preform 120 is inserted into the casting mold 110 prior to introducing a fluid casting material.

The casting mold 110 is of any shape and material suitable for casting a desired molded article. The casting mold 110 is a permanent casting mold or a non-permanent casting mold, i.e., investment casting or sand casting. The casting mold 110 is made from any material suitable for casting which can withstand the melting temperatures and other casting conditions under which the desired molded article is produced.

Figure 2:
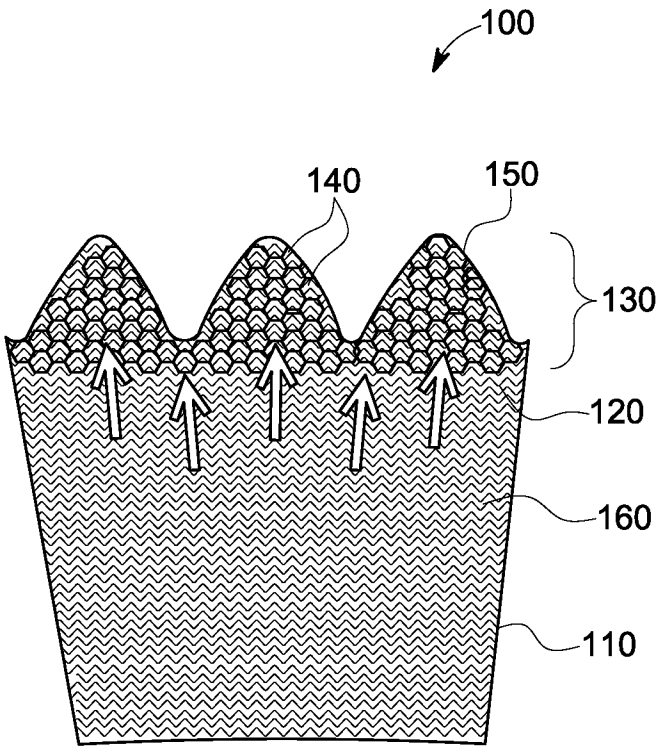
FIG. 2 is a cross-sectional view of a casting preform infiltrated with a fluid casting material.

Referring to FIG. 2, after the casting preform 120 is inserted into the casting mold 110, a fluid casting material 160 is introduced into the casting mold 110. The fluid casting material 160 is introduced into the casting mold 110 by any means suitable for casting. In an embodiment, the fluid casting material 160 is poured into the casting mold 110. In another embodiment, the fluid casting material 160 is injected into the casting mold 110. The fluid casting material 160 is any fluid material which is suitable for casting. Examples of a suitable fluid casting material 160 include, but are not limited to, molten metal, steels and cast irons, superalloys, stainless steel, copper alloys, cobalt alloys, titanium alloys or a combination comprising at least one of the foregoing.

When the fluid casting material 160 is introduced into the casting mold 110, the fluid casting material 160 interacts with and infiltrates the casting preform assembly 130 of the casting preform 120, or more specially, fills the voids between or surrounding the bodies in the plurality of geometrically shaped bodies 140 in the casting preform assembly 130. The casting preform assembly 130 is incorporated into the fluid casting material 160, forming a fluid casting material-casting preform assembly matrix. In an embodiment, the plurality of geometrically shaped bodies 140 which form the casting preform assembly 130 are uniformly distributed throughout a portion of the fluid casting material 160, e.g., within the outer area of the casting mold 150. In another embodiment, the plurality of geometrically shaped bodies 140 reacts with the fluid casting material 160. In yet another embodiment, the plurality of geometrically shaped bodies 140 does not react with the fluid casting material 160.

In a specific embodiment, the plurality of geometrically shaped bodies 140 are dissolved or partially dissolved in the fluid casting material 160 to form fine dispersoids within the fluid casting material-casting preform assembly matrix. In an aspect of the embodiment, in addition to the intact casting preform assembly 130, i.e., the portion which is not dissolved, the fine dispersoids provide additional reinforcement of physical properties to the molded article, including, but not limited to, increased tensile strength. In another aspect of the embodiment, the dispersoids react in-situ with the fluid casting material 160 to form new composites including, but not limited to, composites of carbide, nitride, oxide, boride, an intermetallic compound, or the like, or a combination comprising at least one of the foregoing. For example, in a specific embodiment, the plurality of the geometrically shaped bodies 140 comprise titanium which when dissolved to form dispersoids react in situ with the fluid casting material 160 to form titanium carbide.

The composition of the plurality of geometrically shaped bodies 140 and their arrangement in the casting preform assembly 130 is selected according to the reinforced physical properties desired and the particular application in which the molded article will be used. The physical property reinforced by the use of the casting preform 120 to form a molded article is any desired physical property. Examples of physical properties imparted, or reinforced, by use of the casting preform 120 include, but are not limited to, wear resistance, tensile strength, creep strength, resistance to oxidation, resistance to fatigue, increased thermal stability, or a combination comprising at least one of the foregoing. In an embodiment, the casting preform assembly 130 material also includes additives, including but not limited to, wear-resistant, galling-resistant, oxidation-resistant, friction modifying, lubricative additives, or a combination comprising at least one of the foregoing.

In an embodiment, a molded article cast using the casting preform provided herein has between about 5% to about 30% increased wear resistance relative to a molded article produced without the casting preform as measured by ASTM G-77: Standard Test Method for Ranking Resistance of Materials to Sliding Wear Using Block-on-Ring Wear Test. In another embodiment, a molded article cast using the casting preform provided herein has between about 10% to about 25% increased wear resistance relative to a molded article produced without the casting preform as measured by ASTM G-77. In yet another embodiment, a molded article cast using the casting preform provided herein has between about 10% to about 20% increased wear resistance relative to a molded article produced without the casting preform as measured by ASTM G-77.

In an embodiment, a molded article cast using the casting preform provided herein has between about 5% to about 30% increased fatigue resistance relative to a molded article produced without the casting preform as measured by ASTM E-466: Standard Practice for Conducting Force Controlled Constant Amplitude Axial Fatigue Tests of Metallic Materials. In another embodiment, a molded article cast using the casting preform provided herein has between about 10% to about 25% increased fatigue resistance relative to a molded article produced without the casting preform as measured by ASTM E-466. In yet another embodiment, a molded article cast using the casting preform herein has between about 10% to about 20% increased fatigue resistance relative to a molded article produced without the casting preform as measured by ASTM E-466.

In an embodiment, a molded article cast using the casting preform provided herein has between about 5% to about 30% increased tensile strength relative to a molded article produced without the casting preform as measured by ASTM E-8: Standard Test Methods for Tension Testing of Metallic Materials. In another embodiment, a molded article cast using the casting preform provided herein has between about 10% to about 25% increased tensile strength relative to a molded article produced without the casting preform as measured by ASTM E-8. In yet another embodiment, a molded article cast using the casting preform provided herein has between about 10% to about 20% increased tensile strength relative to a molded article produced without the casting preform as measured by ASTM E-8.

In an embodiment, a molded article cast using the casting preform provided herein has between about 5% to about 30% increased creep strength relative to a molded article produced without the casting preform as measured by ASTM E-139: Standard Test Methods for Conducting Creep, Creep-Rupture, and Stress-Rupture Tests of Metallic Materials. In another embodiment, a molded article cast using the casting preform provided herein has between about 10% to about 25% increased creep strength relative to a molded article produced without the casting preform as measured by ASTM E-139. In yet another embodiment, a molded article cast using the casting preform provided herein has between about 10% to about 20% increased creep strength relative to a molded article produced without the casting preform as measured by ASTM E-139.

The plurality of geometrically shaped bodies 140 which form the casting preform assembly 130 are two-dimensional (2-D) or three-dimensional (3-D) structures, or scaffoldings, of stable, i.e., inert, high-modulus, high-strength, high-hardness, solid or semi-solid phase material, or a combination comprising at least one of the foregoing. In an embodiment, the plurality of geometrically shaped bodies 140 is formed of a solid phase material. In a specific embodiment, the plurality of geometrically shaped bodies 140 is in the form of a powder. The casting preform 120 is formed using any suitable process, including but not limited to, powder processing, sintering, laser sintering, 3-D printing, weaving, honeycomb molding, foam processing, injection molding, slip casting and other conventional fabrication processes such as extrusion, welding, brazing or a combination comprising at least one of the foregoing processes.

For example, in an embodiment, a 2-D or 3-D casting preform assembly 130 is a ceramic scaffolding formed using a foam processing method. Foam processing of ceramic scaffoldings involves the use of sponges or polymer foam precursors as substrates that are impregnated by a ceramic slurry. Sponge-substrates are cut to the desired geometry to form the plurality of geometrically shaped bodies 140 and also to allow for chaplet formation. The sponge substrates are impregnated with the ceramic material by dipping the substrates into ceramic slurry. After drying, the sponge substrates are burned off and then the ceramic scaffolding is fired at elevated temperatures to gain strength. The resulting casting preforms are then placed into the casting mold with the help of in-situ chaplets formed during casting preform processing. The casting mold is heated and filled with a fluid casting material to make reinforced articles.

In another embodiment, the casting preform 120 is formed using laser sintering. In laser-sintering, the desired casting preform assembly 130, or scaffolding, model is generated using a CAD program and the CAD model is transferred to a 3-D laser sintering/printing machine that is loaded with powder that can be metallic, intermetallic, or a composite powder of a metallic and carbide, nitride, boride, or oxide material, as-desired. A suitable metallic support structure built by 3-D laser sintering is used as a substrate for the plurality of geometrically shaped bodies 140 to build the casting preform assembly 130, or scaffolding, step-by-step using an essentially 3-D printing technique. In 3-D printing, any type of powder metallic, ceramic or a combination thereof is printed using a CAD model and a suitable binder. Upon completion of the 3-D scaffolding, or casting preform assembly 130, the binder is burned-off and the resulting casting preform 120 is sintered and/or fired at elevated temperatures to gain full strength. The shape, size, morphology, composition and assembly of the plurality of geometrically shaped bodies 140 are selected according to the particular application for the molded article, the fluid casting material 160 used to form the molded article and the desired physical properties of the molded article.

Although the individual bodies in the plurality of geometrically shaped bodies 140 are depicted in FIG. 1 and FIG. 2 as being hexagonal in shape, the specific shape of the individual bodies is of any suitable shape for forming the casting preform 120. The individual bodies in the plurality of geometrically shaped bodies 140 are two- or three-dimensional, or a combination comprising at least one the foregoing. Suitable geometric shapes formed by the individual bodies in the plurality of geometrically shaped bodies 140 include, but are not limited to, three-dimensional, multi-faceted, shapes such as spherical, cubic or cubic or hexagonal honeycomb, hexagonal, rectangular, polygonal, cylindrical and triangular (or pyramidal) shapes. Other examples of suitable geometric shapes formed by the individual bodies in the plurality of geometrically shaped bodies 140 include, but are not limited to, tetrahedral, octahedral, tetrahedral-octahedral honeycomb, icosahedra, dodecahedral, ellipsoid and hexagonal packing of spheres. In an embodiment, the individual bodies in the plurality of geometrically shaped bodies 140 are a uniform shape of the same type. In another embodiment, the individual bodies in the plurality of geometrically shaped bodies 140 have at least two different types of shapes. In another embodiment, the individual bodies in the plurality of geometrically shaped bodies 140 have a hollow body structure.

In an embodiment, the plurality of geometrically shaped bodies 140 which form the casting preform assembly 130, or scaffolding, has a desired wettability, which helps to develop good bonding at the interface of the casting preform assembly and the fluid casting material, and formation of a stable fluid casting material-casting preform assembly matrix composite. The wettability feature of the casting preform assembly 130 is controlled by various methods to adjust physical and chemical properties of the casting preform materials and the fluid casting material. These methods include, but are not limited to, coating the casting preforms with a flux to mitigate formation of oxides or undesired chemical reactions at the interface with metallic alloys, selection of the chemical composition of the casting preform, the chemical composition of the fluid casting material, increased acceleration of the fluid casting material, the addition of wetting agents to the fluid casting material, or a combination thereof. For example, in an embodiment, the chemical composition of either the casting preform or the fluid casting material, or both, is modified by addition of one or more reactive elements such as Ti, Al, Hf, Zr, Y or a combination comprising at least one of the foregoing which preferentially react with the casting preform or fluid casting material when the fluid casting material is introduced into the casting mold. In the case of acceleration of fluid casting material by centrifugal casting or high-pressure casting, an oxide-layer formed on the fluid casting material front is broken due to the acceleration and interference with the mold and virgin-fluid casting material, and will wet the casting preform, coating the casting preform with flux to reduce the formation of oxides.

In general, the individual bodies in the plurality of geometrically shaped bodies 140 in the casting preform 120 have an average diameter of between about 1 nanometer and about 1 centimeter. In an embodiment, the individual bodies in the plurality of geometrically shaped bodies 140 have an average diameter of from about 1 micrometer to about 500 micrometers. In another embodiment, the individual bodies in the plurality of geometrically shaped bodies 140 have an average diameter of from about 1 micrometer to about 300 micrometers. In yet another embodiment, the individual bodies in the plurality of geometrically shaped bodies 140 have an average diameter of from about 1 micrometer to about 200 micrometers. In still another embodiment, the individual bodies in the plurality of geometrically shaped bodies 140 have an average diameter of from about 10 micrometers to about 100 micrometers.

In another embodiment, the individual bodies in the plurality of geometrically shaped bodies 140 have an average diameter of between about 1 nanometer to about 1000 nanometers. In another embodiment, the individual bodies in the plurality of geometrically shaped bodies 140 have an average diameter of between about 1 nanometer to about 500 nanometers. In yet another embodiment, the individual bodies in the plurality of geometrically shaped bodies 140 have an average diameter of between about 20 nanometers to about 200 nanometers. In still another embodiment, the individual bodies in the plurality of geometrically shaped bodies 140 have an average diameter of between about 50 nanometers to about 150 nanometers.

In an embodiment, the individual bodies in the plurality of geometrically shaped bodies 140 in the casting preform 120 have a uniform size range within about 1 nanometer to about 1000 nanometers. In another embodiment, the individual bodies in the plurality of geometrically shaped bodies 140 in the casting preform 120 have a uniform size range within about 1 nanometer to about 500 nanometers. In yet another embodiment, the individual bodies in the plurality of geometrically shaped bodies 140 in the casting preform 120 have a uniform size range within about 1 nanometer to about 300 nanometers. In still another embodiment, the individual bodies in the plurality of geometrically shaped bodies 140 in the casting preform 120 have a uniform size range within about 10 nanometers to about 200 nanometers. In another embodiment, the individual bodies in the plurality of geometrically shaped bodies 140 have a non-uniform size distribution. The individual bodies in the plurality of geometrically shaped bodies 140 in the casting preform 120 are uniformly or non-uniformly distributed throughout the casting preform assembly 130. In a specific embodiment, the individual bodies in the plurality of geometrically shaped bodies 140 are uniformly distributed throughout the casting preform assembly 130. In another embodiment, the plurality of geometrically shaped bodies 140 is periodically repeated throughout the casting preform assembly 130. In another embodiment, the plurality of geometrically shaped bodies 140 is aperiodically repeated throughout the casting preform assembly 130.

The individual bodies in the plurality of geometrically shaped bodies 140 in the casting preform 120 are arranged or interconnected to form the overall casting preform assembly 130. In an embodiment, the individual bodies in the plurality of geometrically shaped bodies 140 are arranged such that cavities or voids separate the individual bodies. In a specific embodiment, the individual bodies in the plurality of geometrically shaped bodies 140 are arranged according to a selected packing density. In a specific embodiment, the individual bodies in the plurality of geometrically shaped bodies 140 are arranged to achieve a maximum packing density. In another embodiment, the individual bodies in the plurality of geometrically shaped bodies 140 are interconnected via a common element, including but not limited to, a common wall or rod, shared between at least two adjacent bodies.

The materials used to form the individual bodies in the plurality of geometrically shaped bodies 140 are any material suitable for use in molding. The specific materials selected depend on a variety of factors, including but not limited to, the application for the molded article, the desired physical properties in the reinforced molded article, the type of molding process and conditions, or a combination comprising at least one of the foregoing.

Suitable materials for the individual bodies in the plurality of geometrically shaped bodies 140 include but are not limited to metal, metal alloys, metal alloy composites, metal matrix composites (MMC), intermetallics, ceramic, ceramic-ceramic composites or a combination comprising at least one of the foregoing. Examples of suitable materials include, but are not limited to, aluminum, alumina, calcium, carbon, glass, graphite, copper, iron, nickel, mica, wollastonite, molybdenum, silicon, chromium, zirconium, cerium, yttrium, magnesium, manganese, vanadium, hafnium, tantalum, boron, cobalt, tungsten, titanium, carbides, borides, oxides or nitrides of any of the foregoing, or a combination comprising at least one of the foregoing. In an embodiment, the material for the individual bodies in the plurality of geometrically shaped bodies 140 is selected from the group consisting of ceramic, metal and a combination comprising at least one of the foregoing and the shape for the individual bodies in the plurality of geometrically shaped bodies 140 is selected from the group consisting of spheres, cubes, hexagons and a combination comprising at least one of the foregoing. In a specific embodiment, the material used for the individual bodies in the plurality of geometrically shaped bodies 140 is WC-Co or a combination comprising WC-Co. In another specific embodiment, the material used for the individual bodies in the plurality of geometrically shaped bodies 140 includes nickel, boride, e.g., $TiB_2$, cobalt, e.g., Stellite®-6, -T400, or -T800, or a combination comprising at least one of the foregoing. In yet another specific embodiment, the material used for the individual bodies in the plurality of geometrically shaped bodies 140 is $Cr_2C_3$—Ni or a combination comprising $Cr_2C_3$—Ni.

Figure 3:
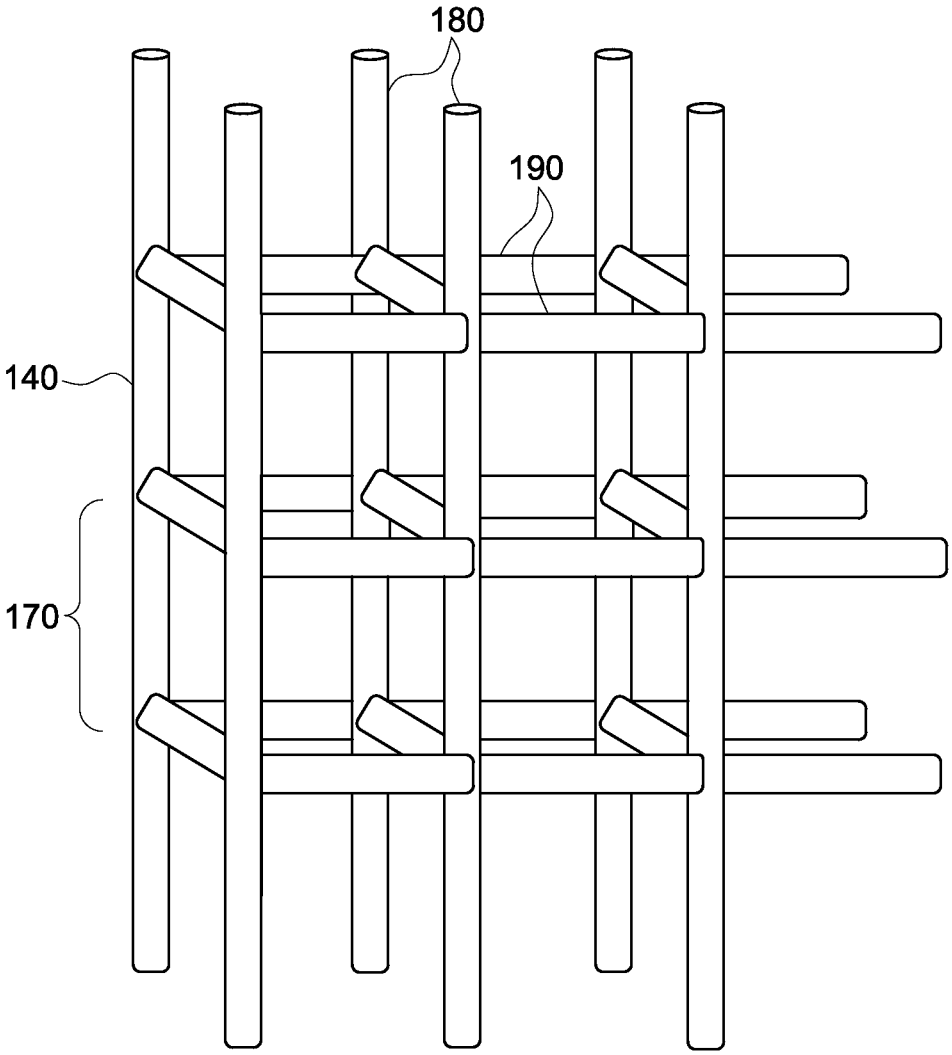
FIG. 3 is a cross-sectional view of a casting preform wherein the casting preform comprises a hollow body structure.

Referring to FIG. 1, FIG. 2 and FIG. 3, in an embodiment, the bodies in the plurality of geometrically shaped bodies 140 have a hollow body structure. The hollow body structure is a two-or three-dimensional form. The hollow body structure of the bodies in the plurality of geometrically shaped bodies 140 is of any desired shape, including but not limited to, cubical, hexagonal, or spherical shapes or the like or a combination of at least one of the foregoing. In a specific embodiment, the hollow body structure is in the form of a cubical cell 170.

In an embodiment, the bodies in the plurality of geometrically shaped bodies 140 in the casting preform 120 have a hollow body structure comprising rods 180 and bars 190 which have an average diameter of from about 1 micrometer to about 1 centimeter. In another embodiment, the bodies in the plurality of geometrically shaped bodies 140 in the casting preform 120 have a hollow body structure comprising rods 180 and bars 190 which have an average diameter of from about 100 micrometers to about 1 centimeter. In yet another embodiment, the bodies in the plurality of geometrically shaped bodies 140 in the casting preform 120 have a hollow body structure comprising rods 180 and bars 190 which have an average diameter of from about 200 micrometers to about 800 micrometers. In still another embodiment, the bodies in the plurality of geometrically shaped bodies 140 in the casting preform 120 have a hollow body structure comprising rods 180 and bars 190 which have an average diameter of from about 300 micrometers to about 600 micrometers.

In another embodiment, the rods or bars, or both, are tubes. In yet another embodiment, the rods 180 are disposed in a position which is perpendicular to the outer area of the casting mold 150, or more particularly, perpendicular to the surface of the article that is molded using the casting mold 110. In yet another embodiment, the cubical cells 170 provide increased creep strength to a molded article produced using the casting mold 150 and casting preform 120.

Figure 4:
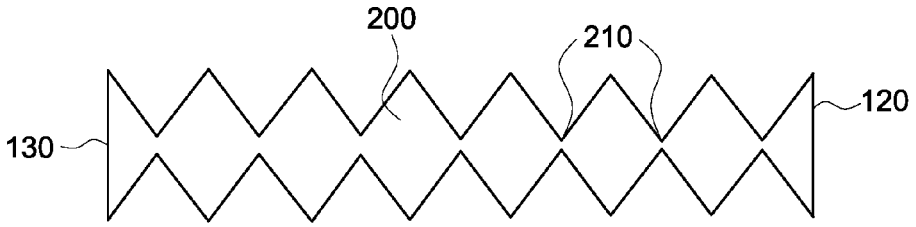
FIG. 4 is a cross-sectional view of a casting preform wherein the casting preform comprises reinforcing segments interposed adjacent to breaking points.

Referring to FIG. 2 and FIG. 4, in an embodiment, the casting preform 120 comprises reinforcing segments 200 interposed adjacent to breaking points 210 which allow one or more of the reinforcing segments 200 to be separated from the overall casting preform assembly 130. The reinforcing segments 200 comprise a plurality of geometrically shaped bodies 140. During the casting process, the breaking points 210 interact with the fluid casting material 160, resulting in separation of one or more of the reinforcing segments 200 from the casting preform assembly 130. The breaking points 210 dissolve or melt upon contact with or exposure over time to the fluid casting material 160.

Figure 5:
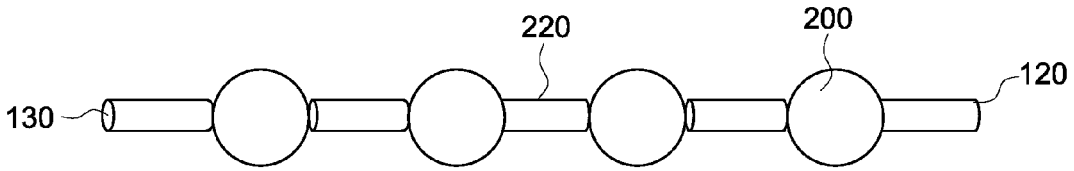
FIG. 5 is a cross-sectional view of a casting preform wherein the casting preform comprises reinforcing segments interposed adjacent to dissolvable linkages.

Referring to FIG. 2 and FIG. 5, in another embodiment, reinforcing segments 200 are interposed adjacent to linkages 220, i.e., ties, which dissolve or melt upon contact with or exposure over time to the fluid casting material (not shown). In another embodiment, the breaking points 210 in FIG. 4 or the linkages 220 in FIG. 5 allow the reinforcing segments 200 to be uniformly distributed throughout a portion of the fluid casting material 160 in the outer area of the casting mold (not shown) when the reinforcing segments are denser than the fluid casting material and centrifugal force is applied. In yet another embodiment, the reinforcing segments are interposed adjacent to breaking points, linkages, or the like, or a combination of at least one of the foregoing.

Figure 6:
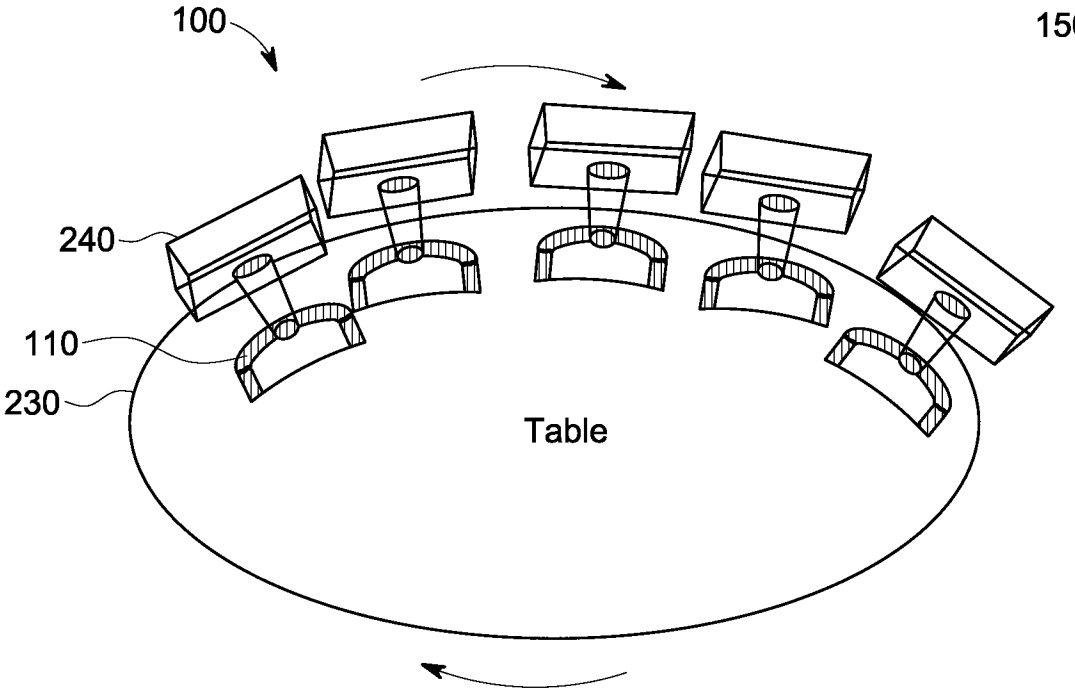
FIG. 6 is a schematic view of a centrifugal casting arrangement comprising individual casting molds.

Referring to FIG. 6, in an embodiment, the type of casting process used to form the molded article is centrifugal casting or die-casting. In a specific embodiment, the type of casting process used to produce the molded article is centrifugal casting. In an aspect of the embodiment, a method for forming a molded article comprises forming a casting preform comprising a casting preform assembly, wherein the casting preform assembly comprises a plurality of geometrically shaped bodies; anchoring the casting preform to an outer surface of a casting mold; introducing a fluid casting material into the casting mold; applying centrifugal force to the casting mold; and forming a molded article, wherein at least a portion of the surface of the molded article is reinforced with the plurality of geometrically shaped bodies.

In an embodiment, the molding apparatus 100 comprises a rotating table 230. The casting molds 110 are disposed in or on the rotating table 230. In a specific embodiment, the casting molds 110 are disposed in a vertical configuration relative to the rotating table 230. Each casting mold 110 comprises a fluid casting material supply chamber 240. A fluid casting material (not shown) is supplied from the fluid casting material supply chamber 240 to the casting mold 110. Each casting mold 110 is separate from the other casting molds, allowing individual molded articles to be cast separately.

Figure 7:
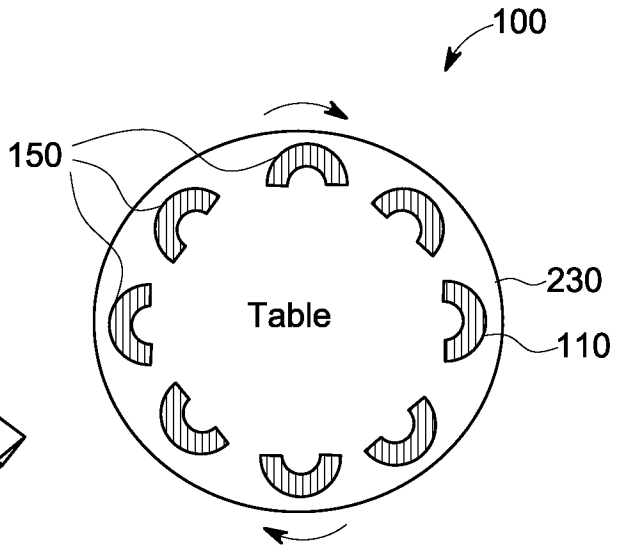
FIG. 7 is a schematic view of a centrifugal casting arrangement comprising individual casting molds wherein targeted reinforcement of physical properties is provided to an outer area of the individual casting molds.

Referring to FIG. 7, the casting preform (not shown) is disposed in a casting mold 110 followed by a fluid casting material (not shown). When a centrifugal force is applied to the rotating table 230, the centrifugal force pushes the fluid casting material in an outboard direction relative to the rotating table 230, causing the fluid casting material to infiltrate the casting preform assembly 130. Upon solidification, i.e., cooling, of the fluid casting material 160, the plurality of geometrically shaped bodies (not shown) is fixed into a position of the outboard area of the molded article, or the outer area of the casting mold 150. This results in the targeted reinforcement of physical properties in the outer area of the casting mold 150, corresponding to the surface or a portion of the surface of a molded article where one or more reinforced physical properties are desired.

Figure 9:
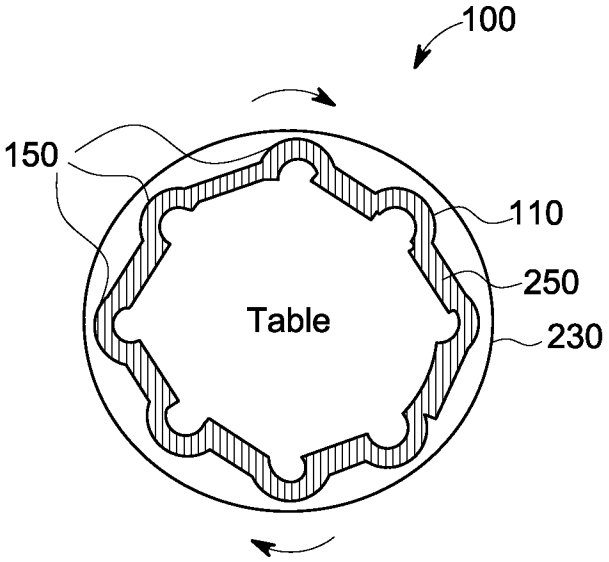
FIG. 9 is a schematic view of a centrifugal casting arrangement comprising a one-piece casting mold wherein targeted reinforcement of physical properties is provided to an outer area of the one-piece casting mold.
Figure 8:
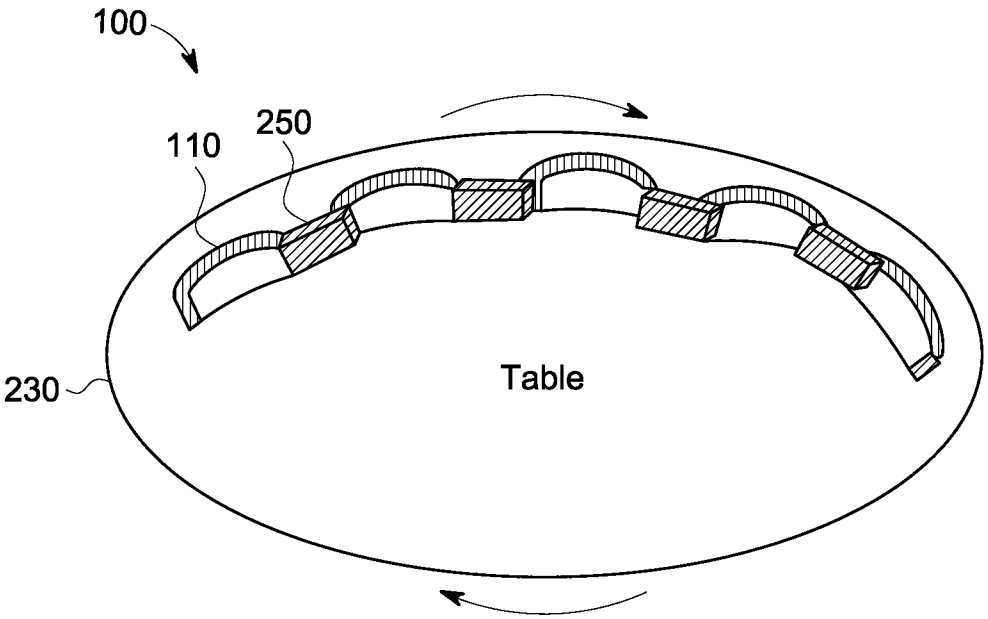
FIG. 8 is a schematic view of a centrifugal casting arrangement comprising a one-piece casting mold.

Referring to FIG. 8 and FIG. 9, in another embodiment, instead of casting individual parts or molded articles, in another configuration, the rotating table 230 is arranged such that the parts are combined into a larger, one-piece casting. The casting molds 110 are connected to one another via a casting mold connector 250. The casting mold connector allows the fluid casting material 160 to flow freely between the casting molds 110. The shape of the casting molds 110 and the casting mold connector are any shape(s) desired to produce the desired one-piece molded article.

Although the direction of rotation for the rotating table 230 is depicted as clockwise in FIGS. 6, 7, 8 and 9, in an embodiment, the direction of rotation for the rotating table is clockwise or counter-clockwise, .

The specific casting conditions selected vary with the type of casting preform used, the type of molded article being cast and the type of fluid casting material used. The selected temperature of the fluid casting material 160 will depend on the specific fluid casting material used. In an embodiment, the fluid casting material is introduced into the casting mold 110 at a superheat temperature of between about 100° F. and about 500° F. above the liquidus temperature, i.e., liquid phase temperature, of the fluid casting material 160, more specifically between about 120° F. and about 210° F., and even more specifically between about 140° F. and about 190° F. above the liquidus temperature.

The specific rotation speed selected will vary with the type of casting preform used, the type of molded article, i.e., the complexity or detail of the features of the molded article being cast and the type of fluid casting material used. In an embodiment, the rotating table 230 is rotated at a velocity that generates a centrifugal force of about 50 G to about 130 G. In another embodiment, the rotating table 230 is rotated at a velocity that generates a centrifugal force of about 70 G to about 120 G. In yet another embodiment, the rotating table 230 is rotated at a velocity that generates a centrifugal force of about 80 G to about 110 G.

The acceleration speed of the centrifugal force applied to the rotating table 230 provides filling pressures which allow the fluid casting material 160 to infiltrate the casting preform (not shown). The specific acceleration speed or range selected varies with the shape and size of the casting mold 110. In an embodiment, the acceleration speed is between about 20 G and about 80 G. In another embodiment, the acceleration speed is between about 30 G and about 70 G. In yet another embodiment, the acceleration speed is between about 40 G and about 60 G. In a specific embodiment, the selected acceleration range allows the fluid casting material 160 to infiltrate the casting preform 120 such that the individual bodies of the plurality of geometrically shaped bodies (not shown) in the casting preform assembly (not shown) are uniformly distributed in a targeted location in the outer area or a portion of the outer area of the casting mold 150. The resulting casting preform assembly-fluid casting material matrix corresponds to a surface or portion of a surfaces of the molded article produced by the casting process.

The casting preforms and methods provided herein are used to provide targeted reinforcement of one or more physical properties to molded articles. The location of the targeted reinforcement corresponds to a surface or portion of a surface of a molded article where reinforcement of physical properties is desired. The physical properties reinforced using the casting preforms and methods herein include increased wear resistance, tensile strength, bearing strength, creep strength, resistance to oxidation, resistance to fatigue, increased thermal stability, or a combination of at least one of the foregoing physical properties. The reinforced physical properties improve the performance of the molded article, increasing the time between maintenance service intervals and increasing the overall lifetime of use of the molded article.

The types of molded articles produced using the casting preforms and methods provided herein are used in any type of molded article for which targeted reinforcement of physical properties is desired. Types of molded articles produced using the casting preforms and methods provided herein include, but are not limited to, a gas turbine engine component, gas turbine diaphragm, piston, cylinder, bearing, blade, vane shroud, liner, combustor, transition piece, rotor component, exhaust flap, seal or fuel nozzle.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A molding apparatus, comprising:

a casting mold; and a casting preform, the casting preform comprising:

a casting preform assembly; and reinforcing segments that comprise a plurality of geometrically shaped bodies, wherein individual bodies in the plurality of geometrically shaped bodies are alternatingly interconnected by one or more linkages to form the casting preform assembly, the casting preform is retained in a final cast product, wherein each of the reinforcing segments is interposed adjacent to the one or more linkages, and wherein the one or more linkages have a lower melting point than the plurality of geometrically shaped bodies such that the one or more linkages dissolve during casting to permit uniform distribution of the plurality of geometrically shaped bodies of the casting preform assembly are uniformly distributed in a targeted location within the casting mold to shape a molded article.

2. The casting preform of claim 1, wherein the plurality of geometrically shaped bodies are cubic, hexagonal, cylindrical, spherical, triangular, polygonal shapes or a combination of one of the foregoing geometric shapes.

3. The casting preform of claim 1, wherein the plurality of geometrically shaped bodies comprise a ceramic material or metallic material, or a combination comprising at least one of the foregoing materials.

4. The casting preform of claim 1, wherein the plurality of geometrically shaped bodies is periodically repeated throughout the casting preform assembly.

5. The casting preform of claim 1, wherein the bodies in the plurality of geometrically shaped bodies have an average diameter of about 1 micrometer to about 1 centimeter.

6. The casting preform of claim 1, wherein the plurality of geometrically shaped bodies comprise rods and bars to form a cube-like structure, wherein the rods are positioned perpendicular to a surface of a casting mold.

* * * * *